United States Patent [19]

Fenley

[11] 4,390,055

[45] Jun. 28, 1983

[54] DRAPERY CARRIER

[75] Inventor: Joel S. Fenley, Union Lake, Mich.

[73] Assignee: Saf-T-Trac Company, Detroit, Mich.

[21] Appl. No.: 175,782

[22] Filed: Aug. 6, 1980

[51] Int. Cl.[3] ..... A47H 13/14

[52] U.S. Cl. ..... 160/348; 16/87.4 R

[58] Field of Search ..... 160/348, 345, 330; 16/87.4, 87.2, 87 R, 87.6

[56] References Cited

U.S. PATENT DOCUMENTS

| | | | |
|---|---|---|---|
| 1,149,628 | 8/1915 | Byron | 16/287.2 |
| 1,239,919 | 9/1917 | Kirsch | 16/128.4 R |
| 1,606,583 | 11/1926 | Ladd et al. | 24/327 |
| 1,892,448 | 12/1932 | Chapman | 160/348 |
| 1,958,436 | 5/1934 | Hess | 160/348 |
| 2,827,656 | 3/1958 | Weber | 16/87.4 |
| 2,989,120 | 6/1961 | Judkins | 160/19 |
| 3,037,556 | 6/1962 | Zuckerman et al. | 160/348 |
| 3,090,431 | 5/1963 | Stubblefield | 160/345 |
| 3,155,150 | 11/1964 | Silvestre | 160/348 |
| 3,157,907 | 11/1964 | Stall | 16/87.4 R |
| 3,196,511 | 8/1965 | Kintner | 16/87.2 X |
| 3,388,734 | 6/1968 | Silvestre | 160/348 |
| 3,503,434 | 3/1970 | Ford | 16/87.4 |
| 3,951,196 | 4/1976 | Salzmann | 160/345 |
| 4,053,009 | 10/1977 | Edlin | 160/348 |
| 4,153,969 | 5/1979 | Mergenthaler | 160/87 |

FOREIGN PATENT DOCUMENTS

| | | | |
|---|---|---|---|
| 1048686 | 1/1959 | Fed. Rep. of Germany | 160/330 |

*Primary Examiner*—Peter M. Caun
*Assistant Examiner*—Cherney S. Lieberman
*Attorney, Agent, or Firm*—Krass, Young & Schivley

[57] ABSTRACT

A drapery support system includes a conventional rod adapted to slidably support a plurality of carriers. Each carrier has an upper section that engages the rod and a downwardly depending section taking the form of a U-shaped plate with the outer section of its bight secured to the upper section so that the two plate-like arms project downwardly. The arms extend parallel to one another and normally to the axis of the rod and are spaced along the axis of the rod. Holes formed through the two arms act as female sections of a snap fastener to receive a pair of male snap fasteners secured at spaced points along a tape joined to the upper edge of the drape. The spacing between a pair of male snap fasteners on the tape exceeds the distance between the two arms of the carrier so that the drape section between the fasteners extend freely in a drape-like roll.

2 Claims, 7 Drawing Figures

DRAPERY CARRIER

TECHNICAL FIELD

This invention relates to a drapery support system including a plurality of carriers slidably supported on a horizontal rod in which each of the carriers engages a pair of spaced points along an upper edge of the fabric so that the fabric assumes a free roll shape between the points.

BACKGROUND ART

A variety of drapery support systems have been devised in which an edge of the drapery fabric is engaged at spaced points which are drawn together to form pleats. These systems are easier to use in forming a drape than arrangements in which the drapery fabric is sewn together to form the pleats, and they simplify and lower the cost of laundering the drapes.

One popular form of pleat is termed a "roll pleat" in which the drapery forms a sinuous curve back and forth across the axis of the drapery rod. Previous devices for forming such pleats have employed tape sections joining the crests of adjacent pleats to maintain the pleat formation, as for example in U.S. Pat. No. 3,155,150; the provision of stiff, curved, header tapes for attachment to the top of the draperies, as in U.S. Pat. No. 4,053,009; the provision of separate carriers for each fold which support the folds normally to the axis of the curtain rod as in U.S. Pat. No. 1,239,919; or the provision of carriers having cylindrical sections which wrap around the head of the drape to force the drape into a circular form, as in U.S. Pat. No. 3,037,556.

These arrangements each suffer from some limitation, such as the difficulty of laundering the drapery, the artificial appearance of the pleat or the cost and complexity of the pleating device.

U.S. Pat. No. 2,827,656 discloses an arrangement wherein each independent carrier of the drapery system supports an elongated flexible strand or rigid U-shaped hook so that both of the free ends of the hook hang downwardly from the carrier. The ends of the hook are displaced by the carrier along the axis of the drapery rod. The free ends of the hook are sewn to displaced points on the upper edge of the drapery so that a roll pleat is formed by the section of drapery between the points. This arrangement, and the variations thereon illustrated in that patent, do not provide a rigid support for the drapery fabric which forces it to extend normally to the axis of the rod and require that connector members be sewn to the fabric of the drapery rendering it difficult to launder.

SUMMARY OF THE INVENTION

The present invention is directed toward an improved form of drapery support system employing carriers which have an upper section adapted to be slidingly supported within a drapery rod and lower depending sections including a pair of plates spaced along the axis of the rod and projecting normally to the rod axis. These plates each have separable fasteners formed in their surfaces which are adapted to engage complementary separable fasteners formed at spaced intervals on a resilient tape attached to the head of the drapery. The separable fasteners on the tape are formed in pairs with a larger spacing between pairs than between the members of each pair. When the separable fasteners of a pair on the tape are joined to the separable fasteners on the pair of plates on the carrier, the section of drapery between the members of the pair extends as a roll in one lateral direction with respect to the rod. The sections of drapery between adjacent carriers are aligned by the plates of the carrier to extend in the opposite direction to form roll sections which enlarge or contract as the drapery is drawn or opened.

The separable fasteners formed on the pair of plates of each carrier are preferably arranged so that the complementary fastener sections on the drape may be attached either to the opposed interior sections of the plates or the opposite sides of the plates to achieve rolls of different configuration. In this manner the lateral extension of the drapery sections between pairs of adjacent carriers may be varied so that the open length of the drape can be modified.

The drapery support system of the present invention is inexpensive, easy to apply to drapery sections, and permits easy laundering of the drapery.

Other objectives, advantages and applications of the present invention will be made apparent by the following detailed description of several preferred embodiments of the invention. The description makes reference to the accompanying drawings in which:

DETAILED DESCRIPTION OF THE PREFERRED EMBODIMENT

Figure 2:
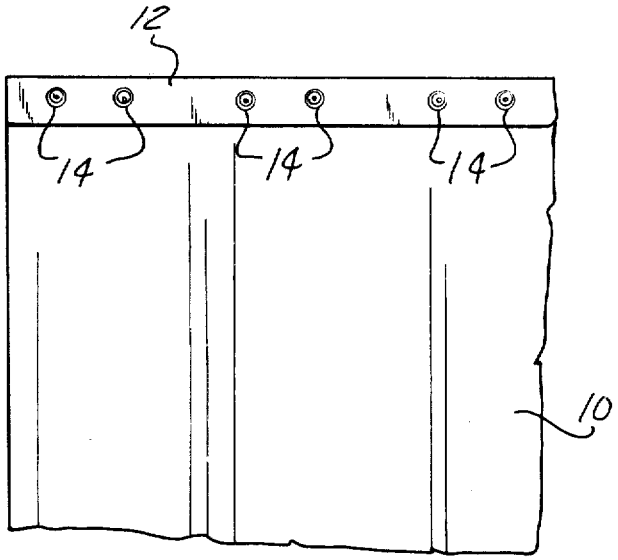
FIG. 2 is a plan view of a drape section with the inventive header tape attached thereto.
Figure 1:
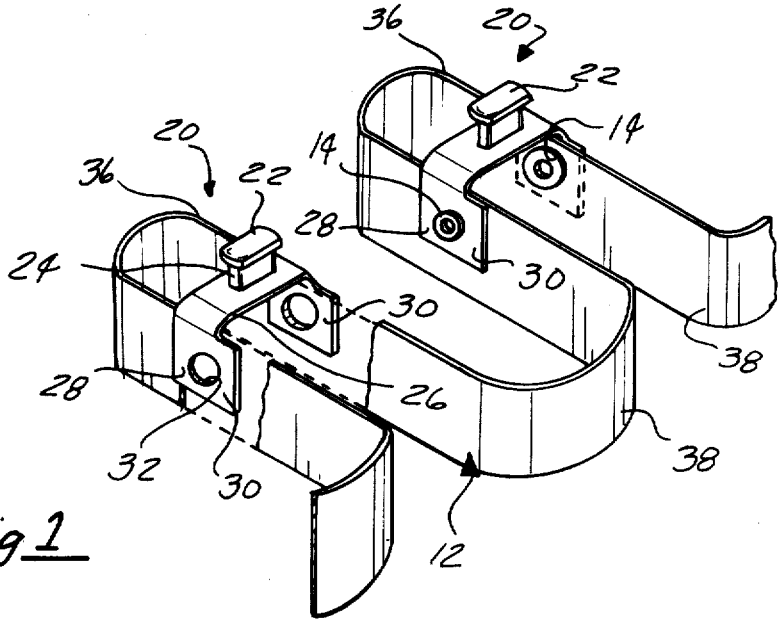
FIG. 1 is a perspective view of a section of the head of a drape equipped with a fastener bearing tape formed in accordance with the present invention attached to a plurality of carriers of the present invention.
Figure 3:
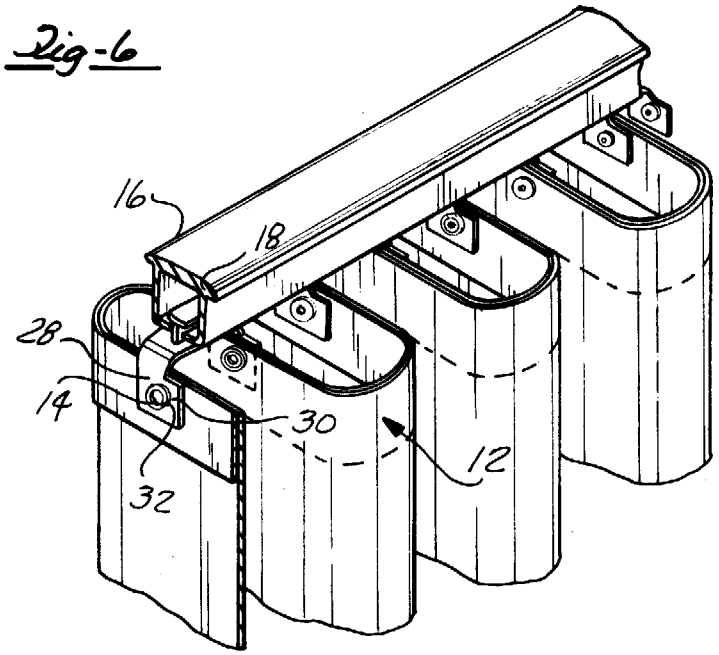
FIG. 3 is a perspective view of a section of a drapery system formed in accordance with the present invention comprising a section of drapery rod, a plurality of carriers, and a drape attached to the carriers.

The embodiment of the invention illustrated in FIGS. 1–4 is used with a section of drapery fabric 10 of conventional non-resilient sheet material such as woven fabric, plastic film or the like. An elongated section of vinyl tape 12 is attached to an upper edge of the drape to form a header. The tape 12 may be formed of plastic film or the like and may be sewn, heat sealed or joined to the edge of the drapery panel by an adhesive. The tape preferably has a sufficient resilience so that when a pair of points spaced along the tape by an inch or more are brought together the section of tape between these points assumes a gentle curve rather than a sharp fold.

The tape 12 supports a plurality of separable fastener sections 14 which are preferably male snap fasteners such as multiple hook and eye fasteners sold under the VELCRO trademark or the like. The separable fastener sections 14 are arranged in pairs, with the members of the pair separated by a few inches. The spacing between the adjacent members of neighboring pairs is preferably greater than the spacing between members of a pair.

For example, in a preferred embodiment of the invention the members of the pair are separated by about three inches and the closest members of two adjacent pairs are separated by about four or five inches.

The drape section 10 is used in connection with an elongated drapery rod 16 which may be of any conventional design. The rod 16 illustrated in FIG. 3 has a channel shaped cross section formed with a bottom slot 18, but the present invention may alternatively be used with solid cylindrical rods, traverse rods of the type having slots on their sides, or other forms of drapery rod. The rod may be straight or curved. In the following application, when reference is made to the axis of the rod, that is intended to apply to the elongate axis of the rod in the immediate section of a carrier.

The preferred embodiment of the invention employs a plurality of carriers, generally indicated at 20, which are adapted to be slidably supported within the rod 16 to retain the header edge of the drape 10. The carriers 20 are preferably formed in a unitary manner as by injection molding of plastic or alternatively may be fabricated from sheet metal or constructed in a composite manner. They each include an upper section 22 adapted to engage the drapery rod 16. In the preferred embodiment of the invention the upper sections 22 of the slides consist of a flat section, or traveler, supported at one end of the post 24. The upper sections 22 are adapted to be supported on the top of the slotted section of the rod 16 with the posts 24 extending downwardly through the slot 18.

The lower section of the sliders, supported on the bottom of the post 24, consists of a generally U-shaped plate section having a central bight 26 and a pair of plate-like U-shaped arms 28. The top of the bight 26 is formed integrally with the bottom of the post 24. The plate-like arms 28 project downwardly from the ends of the bight so that when the slider is supported with its upper section within the rod 16 the plate-like arms 28 are spaced along the axis of the rod and are aligned in planes normal to that axis.

The plates 28 are identical to one another and each has a laterally extending section 30 projecting from its bottom end. The sections 38 lie in a plane normal to the axis of the rod 16 when the traveler is supported within the rod and project laterally beyond the vertical projection of the axis. As will be subsequently noted, these projecting sections act to support and orient abutting sections of the drapery fabric.

The plates 28 are formed with holes 32 adjacent their lower ends. The holes 32 are adapted to receive the male snap fasteners 14 secured to the tape 12. Thus the holes 32 act as female snap fasteners. Since they are formed symmetrically through the plates 28 the snap fastener sections 14 may be secured into the holes 32 from either direction, and in that sense the holes act as pairs of opposingly oriented snap fastener sections. In alternative embodiments of the invention in which alternative forms of separable fasteners are employed, such as hook and eye sections, it would be necessary to attach two fastener sections to opposed sides of the plate 28 in order to duplicate the action of the holes 32.

Each pair of snap fastener sections 14, on the tape 12, are joined to the two separable fastener sections 32 formed on the opposed plates 28 of a single carrier 20. The two fasteners of a pair are preferably joined to the opposed interior sections of the plates 28 so that the drapery section between the pair of fasteners extends in a direction opposed to the direction of projecting of the laterally extending sections 30. The sections of drapery between each pair of fasteners are thus bent resiliently to form a short roll pleat 36. The longer drapery sections between each pair of fasteners 14 project in the opposite direction, are compressed inwardly by the laterally extending sections 28, and form longer rolls 38. These rolls 38 expand and contract as the travelers are moved apart from one another or toward one another by a conventional drapery operating mechanism (not shown).

The carriers thus act to engage the opposed sides of a pleat and to rigidly orient the sides of the pleat laterally relative to the axis of the drapery rod 16. The extending lateral sections give shape to the larger roll pleats.

If it is desired to slightly increase the extended length of the drape the fasteners may be reversed on the plates 28 so that the sides of the pleat are formed over the outer sides of a pair of plates on a carrier. In this manner the laterally extending sections 30 do not force the roll sections 38 laterally outwardly and a pair of carriers may be separated from one another by a greater distance, flattening the rolls 38 between adjacent carriers.

Figure 4:
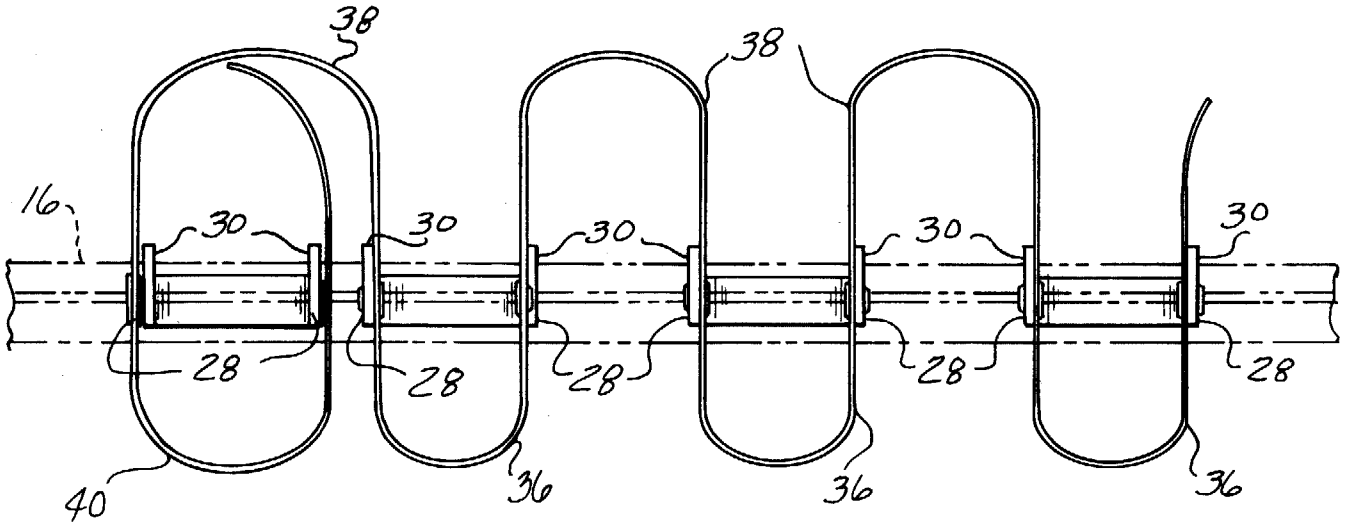
FIG. 4 is a bottom view of the drapery section of FIG. 3.

As is seen in FIG. 4 the end of the drape, at 40, may be formed into a closed roll by bringing the end of the roll 38 around the outer side of the carrier and terminating it on the interior side of the same carrier.

Figure 5:
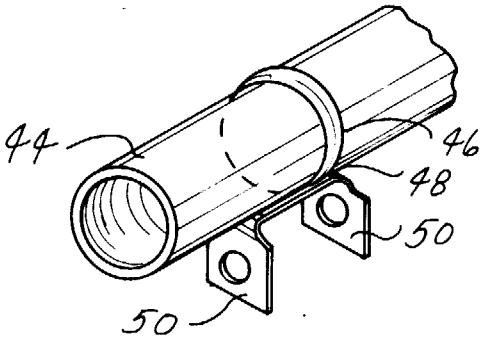
FIG. 5 is a perspective view of an alternative form of drapery carrier.

The present invention may be used with any form of drapery rod and FIG. 5 illustrates an embodiment of the invention employing a cylindrical rod 44. The carrier for the rod includes a rigid ring 46 forming the upper section of the carrier. The lower section of the carrier consists of a bight section 48 connected to the lower end of the ring 46 carrying a pair of flat plate-like arms 50 that extend laterally to the axis of the rod 44.

Figure 6:
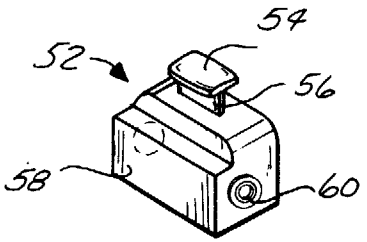
FIG. 6 is a perspective view of another alternative form of drapery carrier.

FIG. 6 illustrates an alternative form of carrier, generally indicated at 52. The upper section of the carrier has a configuration dependent upon the type of rod with which it is to be used. The form illustrated in FIG. 6 includes a flat upper plate 54 intended to be supported in the interior of a slotted rod such as 16. The plate 54 is attached to the upper end of a post 56. A solid block 58 is attached to the bottom of the post 56 and has separable fastener sections 60 formed from its opposed faces. Its opposed faces extend laterally to the axis of a supporting rod so as to give shape to the drapery sections.

Figure 7:
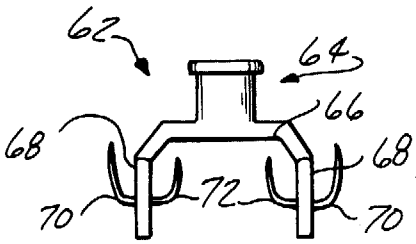
FIG. 7 is an elevational view of another form of drapery carrier embodying the present invention.

Another form of carrier, generally illustrated at 62, is shown in FIG. 7. Its upper section, generally indicated at 64, has a configuration that depends upon a form of rod with which the carrier is to be used. The lower section includes a bight 66 and a pair of axially spaced plates 68 lying in planes normal to the axis of the supporting rod. A pair of upwardly extending metal hooks 70 and 72 are formed on the outer and inner surfaces of each of the plates 68 respectively. The hooks are adapted to directly engage the header of a drape or, alternatively, to fit into vertical pockets sewn on the drape in the conventional manner, so as to secure spaced drapery sections to the carrier. This arrangement eliminates the need for any hardware on the drape, lowering the cost and simplifying laundering, etc.

Having thus described my invention, I claim:

1. A drapery system comprising:

a sheet of flexible drapery material;

a narrow elongated strip formed of a resilient sheet material secured to an elongated edge of the drapery material;

spaced pairs of separable fasteners of a first form secured at spaced intervals along the strip;

an elongated drapery rod;

a plurality of carriers each having a first section adapted to be slidably supported on the rod and a second section depending below the rod, each second section supporting a pair of separate separable fasteners of a second form, complementary to the first form, spaced relative to one another along a line parallel to the length of the rod, the distance between the pair of separable fasteners secured to the second section of each carrier being less than the distance between the two members of each pair of separable fasteners of the first form which are secured to the strip, the lower section of each carrier including a pair of substantially planar surfaces each extending normally to the axis of the rod, the two surfaces being spaced from one another along the axis of the rod, the two planar surfaces formed on the lower section of each carrier being formed by a pair of plates having their upper edges secured to the bottom of the upper sections of each carrier so that the plates project downwardly therefrom to define a downwardly opening passage therebetween, and the two separable fastener sections of the first form being supported one on each of said planar surfaces, whereby the drapery sections carrying said separable fasteners of the first form will be supported laterally to the axis of the rod;

whereby each pair of separable fasteners formed on the strip may be joined to the pair of separable fasteners formed on the second section of a carrier so that the section of the strip between each pair of separable fasteners forms a curved section extending laterally in a first direction from the carrier and the sections of the strip between adjacent carriers extend laterally from the carriers in a second direction to form a roll pleat, said separable fastener of the second form being formed in said plates so as to allow attachment of the fasteners of the first form to either side of the plate.

2. The drapery system of claim 1 wherein said separable fastener of the second form comprise apertures and said first form of complementary separable fasteners means comprise male projections adapted to be inserted into said apertures.

* * * * *